US009233401B2

(12) United States Patent
Miette et al.

(10) Patent No.: US 9,233,401 B2
(45) Date of Patent: Jan. 12, 2016

(54) METHOD AND APPARATUS FOR ASSISTANCE IN SORTING ARTICLES INTO A SORTING CASE

(71) Applicant: SOLYSTIC, Bagneux (FR)

(72) Inventors: Emmanuel Miette, Saint Gratien (FR); Céline Guignard, Issy les Moulineaux (FR)

(73) Assignee: SOLYSTIC, Bagneus (FR)

( * ) Notice: Subject to any disclaimer, the term of this patent is extended or adjusted under 35 U.S.C. 154(b) by 0 days.

(21) Appl. No.: 14/130,179

(22) PCT Filed: Sep. 25, 2013

(86) PCT No.: PCT/FR2013/052252
§ 371 (c)(1),
(2) Date: Dec. 30, 2013

(87) PCT Pub. No.: WO2014/057185
PCT Pub. Date: Apr. 17, 2014

(65) Prior Publication Data

US 2015/0209832 A1 Jul. 30, 2015

(30) Foreign Application Priority Data

Oct. 11, 2012 (FR) ..... 12 59710

(51) Int. Cl.
*B07C 7/02* (2006.01)
*B07C 7/00* (2006.01)

(52) U.S. Cl.
CPC .. *B07C 7/005* (2013.01); *B07C 7/02* (2013.01)

(58) Field of Classification Search
CPC ..... B07C 7/04; B07C 7/005; B07C 7/02
USPC ..... 209/702, 703, 44.4
See application file for complete search history.

(56) References Cited

U.S. PATENT DOCUMENTS

| | | | | |
|---|---|---|---|---|
| 5,881,890 | A * | 3/1999 | Wiley | 209/703 |
| 6,370,446 | B1 * | 4/2002 | Divine | 700/226 |
| 2001/0052485 | A1 * | 12/2001 | Brandsaeter | 209/702 |

* cited by examiner

*Primary Examiner* — David H Bollinger
(74) *Attorney, Agent, or Firm* — Vidas, Arrett & Steinkraus, P.A.

(57) ABSTRACT

A method of manually sorting flat articles (4) into a sorting case (7) comprising sorting slots (8) consists in generating an identification signal (100) designating a sorting slot of said sorting case, into which slot said article to be sorted is to be placed, and then placing said flat articles to be sorted in a stack and in taking the articles one-by-one from the top of the stack. The method also consists in automatically forming (310) digital images (14) of the top of the stack at a certain rate, the digital image of each article of the top of the stack including a sorting indication. Finally, on the basis of the digital image of said article on the top of the stack, the method further consists in automatically generating (330) said identification signal as a flat article is being taken from the top of the stack of flat articles.

14 Claims, 2 Drawing Sheets

METHOD AND APPARATUS FOR ASSISTANCE IN SORTING ARTICLES INTO A SORTING CASE

CROSS-REFERENCE TO RELATED APPLICATIONS

This application is a national stage application of PCT/FR2013/052252, filed on Sep. 25, 2013 and claiming priority to FR 12 59710 filed on Oct. 11, 2012.

TECHNICAL FIELD

The invention relates to a method of sorting articles into a sorting case provided with sorting slots.

The invention relates more particularly to a method of sorting postal articles into a sorting case. The term "postal article" means any type of postal article that can have a variety of dimensions, and that can also have a variety of physical characteristics. Such postal articles may, inter alia, be an ordinary letter, a postcard, a magazine, an envelope with or without a window, a newspaper, or indeed a catalog or a parcel.

The invention also relates to apparatus for assistance in manually sorting objects into a sorting case provided with sorting slots.

PRIOR ART

Sorting postal articles into sorting cases has been in existence for a long time, in particular in post offices. Ordinarily, the sorting is done manually by an experienced operator who firstly puts the postal articles to be sorted in a container, and then takes the articles one-by-one, reads the destination address of each postal article as it is taken, and places it in a sorting slot of the sorting case, which slot corresponds to said destination address. The sorting case that is generally placed on a desk in front of the operator may have its sorting slots aligned in rows and columns in a two-dimensional matrix configuration.

Once the sorting is finished, the sorted postal articles can be retrieved directly from the sorting slots of the sorting case in sequenced manner, e.g. for preparing a delivery round or "postman's walk", or indeed they can be transferred to another piece of sorting apparatus in order to perform finer sorting.

It is known that certain systems for sorting into sorting cases are partially automated. For instance, the system for assistance in sorting into a sorting case that is disclosed in Document U.S. Pat. No. 5,794,789 includes automatic bar code reader means for reading the delivery addresses of the postal articles. A computer then determines the slot of the sorting case that corresponds to that address and causes the slot of the case to open.

Other documents also disclose sorting systems for sorting into cases that are partially automated, such as Documents PCT2004/009257, US2006/0022824, EP 0 928 641 and PCT2010/089785, as well as Documents DE 10 2005 032 533 and U.S. Pat. No. 5,881,890.

Nowadays, time constraints and the increasing number of postal articles are encouraging postal authorities to find technical means for making such manual sorting into sorting cases faster and more reliable.

SUMMARY OF THE INVENTION

An object of the invention is to improve the sorting of articles, and in particular postal articles, into a sorting case.

To this end, the invention provides a method of manually sorting flat articles into a sorting case comprising sorting slots, in which method an identification signal is generated that designates a sorting slot of said sorting case, into which slot said article to be sorted is to be placed, said method being characterized in that it comprises the following steps:

a) placing said flat articles to be sorted in a stack and taking the articles one-by-one from the top of the stack;

b) automatically forming digital images of the top of the stack at a certain rate, the digital image of each article of the top of the stack including a sorting indication placed on said article; and c) on the basis of the digital image of said article on the top of the stack, automatically generating said identification signal as a flat article is being taken from the top of the stack of flat articles.

The basic idea of the invention is thus to give assistance to the operator based on automatically reading an item of sorting information, e.g. the destination address on each of the postal articles to be sorted each time a postal article is taken from the stack of postal articles that are contained in the container, and based on then generating an identification signal designating the sorting-case sorting slot in which said postal article to be sorted is to be placed, as a function of its destination address. In this manner, it is possible to increase the sorting rate of the operator and reduces sorting errors.

The method of the invention may advantageously have the following features:

- the identification signal is a visible signal;
- the identification signal is displayed on a display screen;
- the digital image of the article is displayed on the display screen;
- the identification signal comprises a first item of data indicating a row of the sorting case and a second item of data indicating a column of the sorting case;
- distinct indicator lights are associated with respective ones of the sorting slots of the sorting case, and the identification signal is displayed by an indicator light that is associated with a sorting slot;
- the identification signal is an audible signal emitted by a voice synthesizer;
- an identification signal is generated for a current article to be sorted and a pre-identification signal is generated for another article to be sorted, following the current article, said pre-identification signal designating a sorting slot of the sorting case that corresponds to the sorting indication recognized in the digital image of said other article;
- the identification signals and the pre-identification signals are visually distinct;
- a step is provided consisting in automatically generating an audible availability signal each time a pre-identification signal is generated automatically;
- on the basis of each digital image of an article, an image signature serving as a unique identifier for uniquely identifying said article is computed; this makes it possible to sort into a sorting case in "offline" mode and optionally to retrieve the address information via remote video encoding; and
- the articles are postal articles, and the sorting indication is an item of delivery address information.

The invention also provides apparatus for assistance in manually sorting flat articles into a sorting case comprising sorting slots, in which apparatus a monitoring and control unit is adapted to generate an identification signal that designates a certain sorting slot of the sorting case, into which slot said article to be sorted is to be placed, said apparatus being characterized in that it comprises:

a container for storing said flat articles to be sorted in a stack; and image-taking apparatus adapted to form a digital image of the article to be sorted on the top of the stack;

and in that the monitoring and control unit is adapted to control said image-taking apparatus in such a manner as to form the digital images of the top of the stack automatically at a certain rate, and, on the basis of the digital image of said article on the top of the stack, to generate automatically said identification signal as a flat article is being taken from the top of the stack of flat articles.

BRIEF DESCRIPTION OF THE DRAWINGS

The present invention can be better understood and other advantages appear on reading the following detailed description illustrated by the accompanying drawings, in which.

DESCRIPTION OF IMPLEMENTATIONS

The apparatus of the invention for assistance in manually sorting articles is described below by way of non-limiting example for when the articles are flat postal objects on which address information that constitutes sorting information is placed conventionally. This assistance apparatus may be used in a post office or in a postal sorting center.

Figure 1:
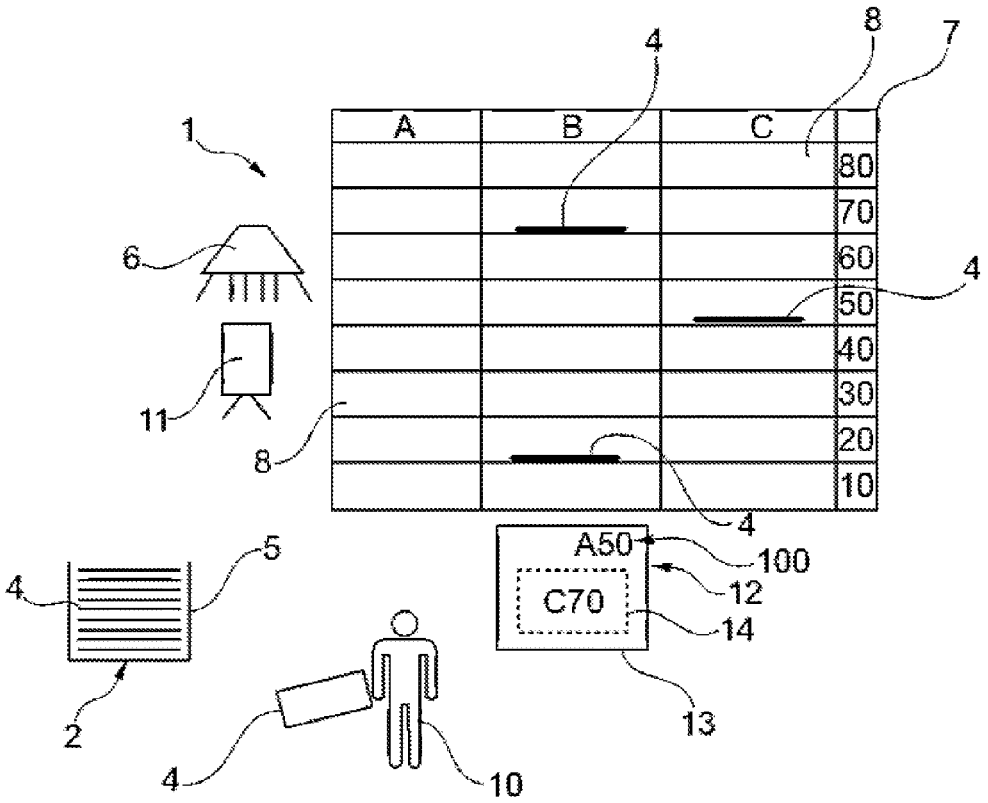
FIG. 1 is a diagrammatic view of apparatus of the invention for assistance in sorting postal articles.

The apparatus 1 for assistance in sorting that is shown in FIG. 1 has various elements, including a container 2, lighting 6, image-taking apparatus 11, a monitoring and control unit 12, and a sorting case 7.

In this example, the container 2 is a storage bin that has a flat bottom 3 and vertical walls 5. The bin is designed to store the postal articles 4 flat and in a vertical stack. The top of the container 2 is open so as to allow an operator indicated by 10 to take the articles 4 one-by-one easily and rapidly from the top of the stack.

Without going beyond the ambit of the invention, it is possible to use a storage bin or tray in which the postal articles are stacked on edge in a horizontal stack, the articles then being taken from one side of the horizontal stack.

In this example, the articles 4 are stored in the container 2 in such a manner that, every time, the article 4 that is at the top of the stack is presented with its face bearing the destination address visible from the outside of the container 2, and, in FIG. 1, visible from the top of the container 2.

The lighting 6 is designed to illuminate homogeneously the articles 4 in the container 2 and more particularly the article 4 at the top of the stack, regardless of the height or the width of the stack. Thus, in the example shown in FIG. 1, the lighting 6 is disposed above the container 2 so as to ensure that the destination address of the article 4 at the top of the stack can be read properly regardless of the conditions of installation of the apparatus 1 for assistance in sorting, in particular when neon lights or windows are present nearby. The intensity, the color and the position of the light emitted by the lighting 6 could also be adjusted automatically depending on the size of the stack, on the color of the articles 4, or on the lighting conditions of the room in which the apparatus 1 for assistance in sorting is placed.

The sorting case 7 is provided with a plurality of sorting slots 8 designed to receive one or more articles 4. In particular, the sorting case 7 is placed facing the operator 10 or at any other place adapted in such a manner that the operator 10 can access the sorting slots 8 quickly and readily. In the example shown in FIG. 1, the sorting case 7 is disposed next to the container 2 so that, in a single movement of the arm, the operator 10 causes an article 4 to go from the container 2 into one of the sorting slots 8 of the sorting case 7. FIG. 1 shows a matrix sorting case 7. The rows and columns of the sorting case 7 are numbered or referenced by a slot identification code visible by the operator 10, and which, in this example, is a code including a letter indicating a column of the sorting case 7, e.g. A, B, C, D, etc., and a number indicating a row of the sorting case 7, e.g. 10, 20, 30, etc.

The image-taking apparatus 11 in the example shown in FIG. 1 is a camera 11 placed above the container 2 so as to take digital images 14 of the article 4 at the top of the stack of articles 4, each digital image 14 then including the destination address on the postal article 4. The camera 11 can be designed to form digital images 14 of the top of the stack automatically and at a certain rate, e.g. to so as to form four digital images 14 per second, throughout the sorting process for sorting into the sorting case. The camera 11 is placed at a suitable distance from the stack of articles 4, e.g. at a distance enabling it to have the entire height of the stack of articles 4 in its depth of field, thereby making it possible to ensure that a sharp digital image 14 is taken of each article 4 as the operator 10 takes the articles 4 from the stack in order to place them in the sorting slots 8 of the sorting case 7.

The monitoring and control unit 12 may be designed to evaluate the destination address of the article 4 at the head of the stack automatically on the basis of the digital image 14 of said article 4 that is produced by the camera 11, via an optical character recognition (OCR) system and a postal address database as is well known for postal sorting machines. But this evaluation of the destination address could have taken place in a postal sorting machine placed upstream in the sorting process. On the basis of the digital image 14 of the article 4, the monitoring and control unit 12 can compute an image signature that is a unique identifier for the article 4 and retrieve, by image signature matching in databases, the sorting and postal address data recognized for said article 4. A sorting plan has been recorded in the monitoring and control unit 12, which sorting plan is an associative table that associates destination addresses with the sorting slots 8 of the sorting case 7. On the basis of the destination address recognized for the article 4 and of the sorting plan, the monitoring and control unit 12 can determine the sorting slot 8 of the sorting case 7 in which the article 4 is to be placed, and can thus produce an identification signal 100 that designates the location of said sorting slot 8 in the sorting case 7. In accordance with the invention, the communications between the camera 11 and the monitoring and control unit 12 may be wired or wireless.

It can be understood that the sorting plan in the monitoring and control unit 12 may be determined dynamically as the sorting progresses, e.g. from the filling of the sorting cases 8 or from the period in the day, or indeed from the quantity of articles 4 to be sorted into the sorting case.

It can also be understood that the recognition of the sorting information on the articles 4 may encompass recognition of various types of marks present on the postal article 4 and recognizable in said digital image 14, such as the destination address, regardless of whether it is typed or handwritten, and also the sender's address, the postage mark, the service indications (priority letter, registered letter, airmail letter, etc.), advertising slogans, etc. as a function of the sorting criteria.

The sorting slot 8 of the sorting case 7 that is determined in the monitoring and control unit 12 may also result from a combination of different items of information that are recognizable in the digital image 14 of the article 4.

The monitoring and control unit 12 automatically generates an identification signal 100 for each article 4 taken from the container 2. For this purpose, it filters out the digital images 14 that are not pertinent, e.g. by comparing two successive digital images 14 taken by the camera 11. If the two digital images 14 are identical, the identification signal 100 is not recomputed. If the two digital images 14 are different, recognition of the address information is launched. If the recognition is unambiguous, i.e. if the two successive digital images 14 concern two different articles 4, a new identification signal 100 is then generated. Conversely, if the recognition is ambiguous or is not completed successfully, the identification signal is not generated. The digital image 14 can be an image of the hand of the operator 10 taken while the operator is taking hold of an object 4 from the head of the stack.

In accordance with the invention, the identification signal 100 is refreshed every time an article 4 is taken from the stack head, this change being, for example, detected by comparing two successive images 14 taken by the camera 11. For comparing two successive digital images 14, it is also possible to use comparison of the image signatures. In accordance with the invention, the monitoring and control unit 12 generates, at the same time, the signal 100 for an article 4 being placed in a sorting slot 8 and also a "pre-identification" other signal 101 that is computed for the article 4 that is already at the top of the stack and that is visible by the camera 12, but that has not yet been taken by the operator 10. This early presentation of the designation of the next article 4 to be sorted makes it possible to further increase the sorting rate.

Figure 2:
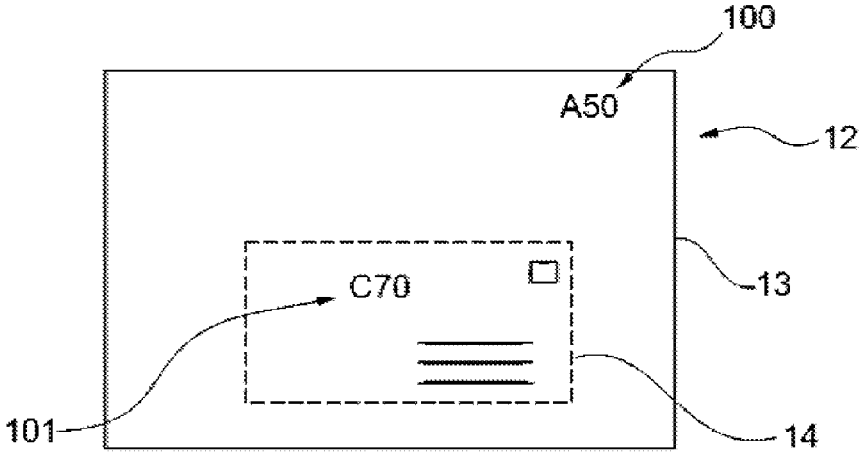
FIG. 2 is an enlarged fragmentary diagrammatic view of a display screen of the apparatus of FIG. 1.

In the example shown in FIG. 1, the identification signals 100 and the pre-identification signals 101 are visual signals displayed on a display screen 13 placed in the vicinity of the sorting case 7 and thus of the operator 10. FIGS. 1 and 2 show an example of display of the identification signal 100, in the form of a concatenation of a row identifier (A in this example) and of a column identifier (50 in this example). The pre-identification signal 101 has the same format as the identification signal 100, and is "C70" in the example. On the display screen 13, the identification signals 100 and the pre-identification signals 101 may be displayed in different colors or with formats of different natures so as that the operator 10 can differentiate between them easily. In FIG. 1, the identification signal 100 is displayed in the center of the display screen 13 with, as the background, the digital image 14 of the article 4 that is being placed in the sorting case 7, while the pre-identification signal 101 is displayed in the top right corner of the display screen 13. It can be understood that, each time an article 4 is taken from the top of the stack in the container 2, the identification signals 100 and the pre-identification signals 101 are refreshed, and that the pre-identification signal 101 takes the place of the identification signal 100 every time.

In the example of FIG. 1, a display screen 13 is used with an integrated monitoring and control unit 12. The display screen 13 may be touch-sensitive screen with a virtual keyboard or a physical keyboard, it being possible for the operator 10 to use the keyboard to input/supplement data relating to the destination address of an article 4, e.g. if the address cannot be read automatically in unambiguous manner.

Figure 3:
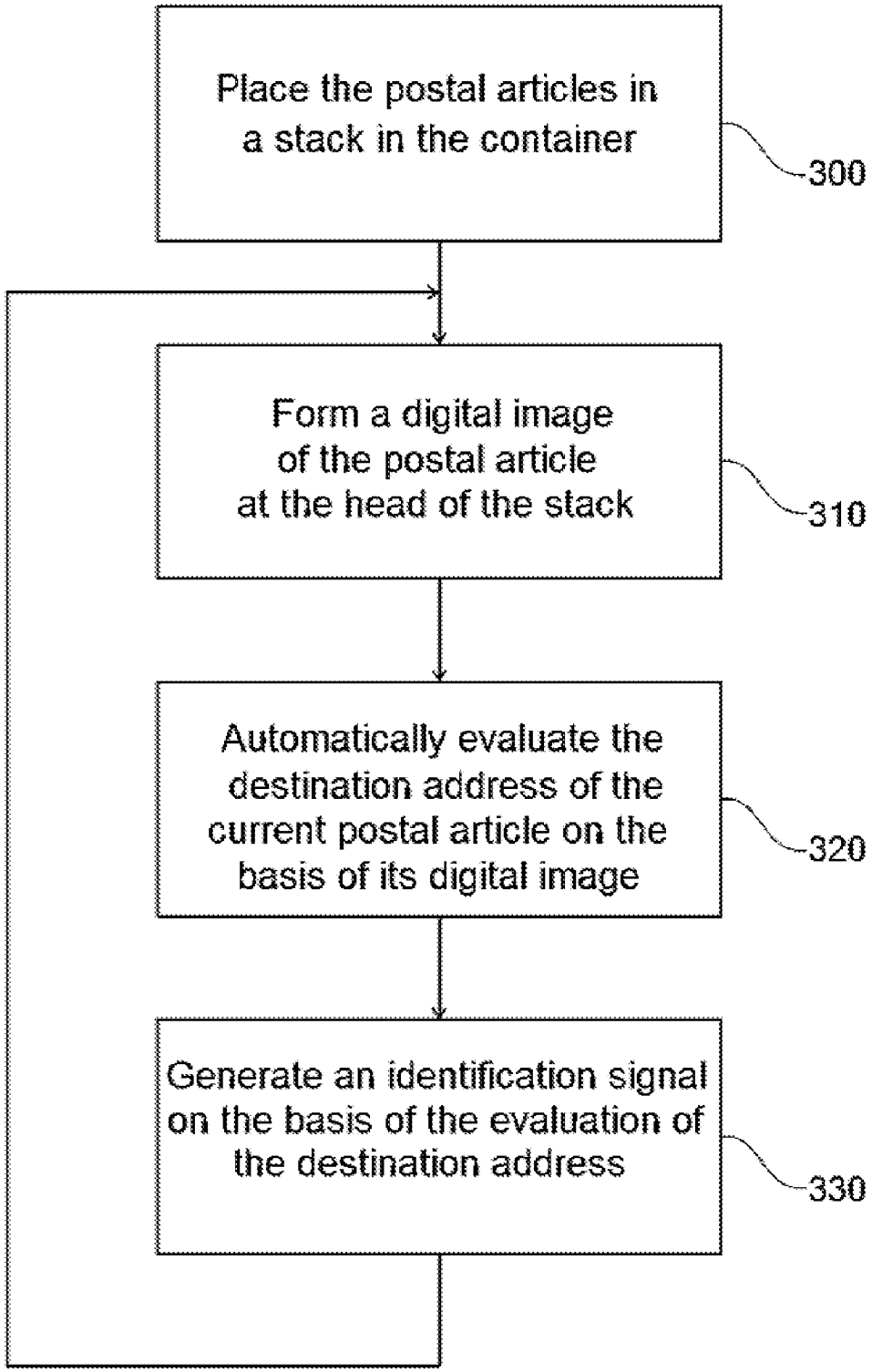
FIG. 3 is a flow chart showing the steps of the method of the invention for manually sorting postal articles into a sorting case.

FIG. 3 shows the main steps of the sorting method of the invention for sorting into the sorting case. At 300, the operator 10 thus places the articles 4 to be sorted in a stack in the container 2, the articles 4 having their faces bearing the address information facing upwards and towards the camera 11. Then, the operator 10 actuates, for example, a key on the touch-sensitive display screen 13, thereby starting a cyclical process of having images input by the camera 11, of evaluating the addresses, and of computing the identification signals 100 and any pre-identification signals 101, and then of presenting said signals, e.g. on the display screen 13.

In particular, at 310, the camera 11 automatically inputs a first digital image 14 of the article 14 at the head of the stack of articles 4. At 320, the digital image 14 is sent to the monitoring and control unit 12 that, in this example, is included in the display screen 13. After performing OCR processing, the monitoring and control unit 12 automatically evaluates the destination address of the current digital image 14. By way of a variant, a digital image signature is computed. Said image signature is a unique identifier V-Id for the current article 4. On the basis of said unique identifier V-Id, results of automatic recognition performed upstream can be retrieved. At 330, on the basis of the recognition of the destination address and of a sorting plan for sorting into the sorting case, the monitoring and control unit 12 automatically computes the identification signal 100, i.e. the location of the sorting slot 8 in the sorting case 7 in which slot the current article 4 to be sorted should be placed. The identification signal 100 is displayed on the display screen 13 in such a manner as to be visible for the operator 10.

As indicated above, as an article 4 is being taken from the head of the stack, in the steps 310-330, a pre-identification signal 101 may be computed jointly and be displayed on the display screen 13. As a result, while the operator is looking, on the display screen 13, at the designation of the sorting slot 8 in which the operator should place the article 4 that the operator is holding in the hand, the operator 10 also sees the designation of the sorting slot 8 in which the next article 4 should be placed. The operator can thus anticipate where it is to be placed, thereby making it possible to accelerate the sorting process.

The method of the invention is also applicable to when the operator 10 puts an article 4 that has already been taken back at the head of the stack. As indicated above, if the monitoring and control unit 12 is provided with a keyboard, the operator 10 may be asked by the system to input the destination address in full or in part, the system acting as a video encoder. If the destination address is not recognizable in the digital image 14 of an article 4, the system may be designed to enable the operator 10 to remove the article 4 from the sorting cycle for sorting into the sorting case. The digital image 14 of the article 4 may then be sent to a remote specialized video-encoding station, and the result of the video-encoding may be stored in a database connected to the monitoring and control unit 12.

By way of a variant (not shown) the sorting case may be provided with indicator lights of the light-emitting diode (LED) type at each sorting slot (one per sorting slot). Display of an identification signal is then performed by switching on the indicator light of the slot designated by said signal. The LED may emit continuous light for the identification signal while the pre-identification signal may be displayed, for example, by a flashing LED signal (or indeed by a signal of some other color).

In another variant of the invention (not shown), the identification signal and the pre-identification signal may be generated by a voice synthesizer. In addition, each time an identification signal or a pre-identification signal is generated, an audible availability signal may be generated by the monitoring and control unit in order to warn the operator that said operator can take hold of the next article in the stack to be sorted.

The sorting method of the invention for sorting into a sorting case may be used in sorting in one pass or in a plurality of sorting passes.

Naturally, the present invention is in no way limited to the above description, which can undergo modifications without going beyond the ambit of the invention.

The invention claimed is:

1. Apparatus (1) for assistance in manually sorting flat articles (4) into a sorting case (7) that includes sorting slots (8), said apparatus comprising:

a monitoring and control unit (12) adapted to generate an identification signal (100) that designates a sorting destination, into which said article (4) to be sorted is to be placed, a container (2) for storing said flat articles to be sorted in a stack; and an image-taking apparatus (11) adapted to form automatically at a certain constant rate digital images (14) of the top of the stack of flat articles (4) in the container, each digital image (14) of the top of the stack including a sorting indication placed on said article (4);

said monitoring and control unit (12) being designed, on the basis of the digital image (14) of the top of the stack, to generate automatically said identification signal (100) as a flat article is being taken from the top of the stack of flat articles; and said monitoring and control unit (12) being further designed to detect that flat article at the top of the stack is taken, by detecting a difference in successive digital images (14) and in response to the detection, refreshing the identification signal (100) corresponding to the next flat article at the top of the stack.

2. The apparatus (1) according to claim 1, further comprising a display screen (13) for displaying said identification signal (100).

3. The apparatus (1) according to claim 1, wherein said display screen (13) is of the touch-sensitive type.

4. The apparatus (1) according to claim 1, wherein said identification signal (100) is a visible signal.

5. The apparatus (1) according to claim 1, wherein said identification signal (100) is displayed on a display screen (13).

6. The apparatus (1) according to claim 5, wherein said digital image (14) of the top of the stack of flat article (4) is displayed on said display screen (13).

7. The apparatus (1) according to claim 1, wherein said identification signal (100) comprises a first item of data indicating a row of said sorting case (7) and a second item of data indicating a column of said sorting case (7).

8. The apparatus (1) according to claim 1, wherein distinct indicator lights are associated with respective ones of said sorting slots (8) of said sorting case (7), and in that said identification signal (100) is displayed by an indicator light that is associated with a sorting slot (8).

9. The apparatus (1) according to claim 1, wherein said identification signal (100) is an audible signal emitted by a voice synthesizer.

10. The apparatus (1) according to claim 1, wherein at the same time, an identification signal (100) is generated for a current article (4) to be sorted and a pre-identification signal (101) is generated by the monitoring and control unit (12) for another article (4) to be sorted, following the current article (4), said pre-identification signal designating a sorting slot (8) of said sorting case (7) that corresponds to the sorting indication recognized in the digital image (14) of said other article (4).

11. The apparatus (1) according to claim 10, wherein said identification signals and said pre-identification signals are visually distinct.

12. The apparatus (1) according to claim 10, further comprising a step consisting in generating an audible availability signal by the monitoring and control unit (12) each time a pre-identification signal is generated by said monitoring and control unit (12).

13. The apparatus (1) according to claim 1, wherein on the basis of each digital image (14) of an article (4), an image signature serving as a unique identifier for uniquely identifying said article (4) is computed by said monitoring and control unit (12).

14. The apparatus (1) according to claim 1, wherein said articles (4) are postal articles, and in that the sorting indication is an item of delivery address information.

* * * * *